United States Patent [19]

Uhlig

[11] Patent Number: 4,533,071

[45] Date of Patent: Aug. 6, 1985

[54] DISPENSING CLOSURE VALVE

[75] Inventor: Albert R. Uhlig, Toledo, Ohio

[73] Assignee: Owens-Illinois, Inc., Toledo, Ohio

[21] Appl. No.: 525,075

[22] Filed: Aug. 22, 1983

[51] Int. Cl.[3] ..... B65D 47/08

[52] U.S. Cl. ..... 222/498; 222/513

[58] Field of Search ..... 222/498, 513, 541, 512, 222/517, 556, 563, 511, 528, 402.22, 402.23; 251/298, 339

[56] References Cited

U.S. PATENT DOCUMENTS

| | | | |
|---|---|---|---|
| 3,776,434 | 12/1973 | Christensen et al. | 222/563 X |
| 4,211,348 | 7/1980 | Scholle | 222/498 |
| 4,444,340 | 4/1984 | Bond | 222/498 |

*Primary Examiner*—Stanley H. Tollberg
*Attorney, Agent, or Firm*—John R. Nelson

[57] ABSTRACT

A dispensing closure valve for a container comprising a stem for attachment to the container, and stem having an annular wall defining an opening and a closure having an annular wall, a radial wall engaging the free end of said stem, a transverse wall being curved and defining a convex surface facing inwardly of the container. The closure includes a downwardly and inwardly inclined integral annular portion defining a sealing surface at the juncture of the axial wall and transverse wall. The stem has a downwardly and outwardly inclined surface engaged by the downwardly and inwardly inclined sealing surface of said closure. An actuator comprising a tab extending axially from the inner surface of the transverse wall for manipulation of the closure to flex the axial wall and the transverse wall and thereby permit the contents to flow between the wall of the stem and the wall of the closure.

8 Claims, 4 Drawing Figures

DISPENSING CLOSURE VALVE

This invention relates to dispensing closure valves for containers and particularly for containers of the flexible wall type.

BACKGROUND OF THE INVENTION

One type of container that is commonly used if of the flexible or bag type commonly known as a "bag in the box" type wherein a dispensing closure is attached to the bag for dispensing the contents such as milk or wine.

Such containers are utilized with dispensing closure valves, for example, such as shown in U.S. Pat. Nos. 3,400,866, 3,443,728, 3,972,452 and 4,211,348. These dispensing closure valves consist of a stem or spout attached to the container and a plastic snap-on closure which has a transverse wall in the form of a frustoconical peripheral portion and a flat transverse bottom portion. The peripheral portion seals against portions of the stem. When it is desired to dispense the contents, a tab on the flat portion is manipulated to flex the frustoconical wall portion out of engagement with the stem.

In U.S. Pat. No. 3,400,866, an annular wall of the transverse wall engages an annular radially inwardly extending bead on the stem to provide the seal. However, internal pressure caused by gravity, dropping the package or by gases within the package will tend to force the seal apart.

Similarly, U.S. Pat. No. 3,443,728 provides for a portion of the transverse wall to engage the free edge of the stem to provide the seal. Internal pressure will tend to move the transverse wall away from the sealing area.

In U.S. Pat. No. 3,972,452, the transverse wall is formed with an annular sealing surface that engages the internal surface of the stem. However, the internal pressure on the transverse wall will tend to pull the cylindrical surface away from the surface of the stem.

In U.S. Pat. No. 4,211,348, the transverse wall is formed with an annular bead that engages the cylindrical surface of the stem. Here again, internal pressure will move the annular bead away from the cylindrical surface.

Among the objectives of the present invention are to provide a dispensing closure valve wherein the sealing pressure increases upon increasing internal pressure; wherein a seal is provided even though a partial vacuum is created within the container when the contents are dispensed and wherein the principal seal is preloaded or pretensioned to insure a proper seal even after the container is empty or a partial vacuum is created by the dispensing of the contents.

In accordance with the invention, the dispensing closure valve for a container comprises a stem for attachment to the container, and having an annular axial wall defining an opening and a closure having an annular axial wall, a radial wall engaging the free end of the stem and a transverse wall which is curved and defines a convex surface facing inwardly of the container. The closure includes a downwardly and outwardly inclined integral annular wall at the area of juncture of the annular wall and bottom wall. The stem has a downwardly and outwardly inclined surface engaged by a downwardly and inwardly inclined surface of said closure. The closure includes an actuator comprising a tab extending axially from the inner surface of the transverse wall for manipulation of the closure to flex the axial wall and the transverse wall and thereby permit the contents to flow between the axial wall of the stem and the axial wall of the closure.

DESCRIPTION

Figure 1:
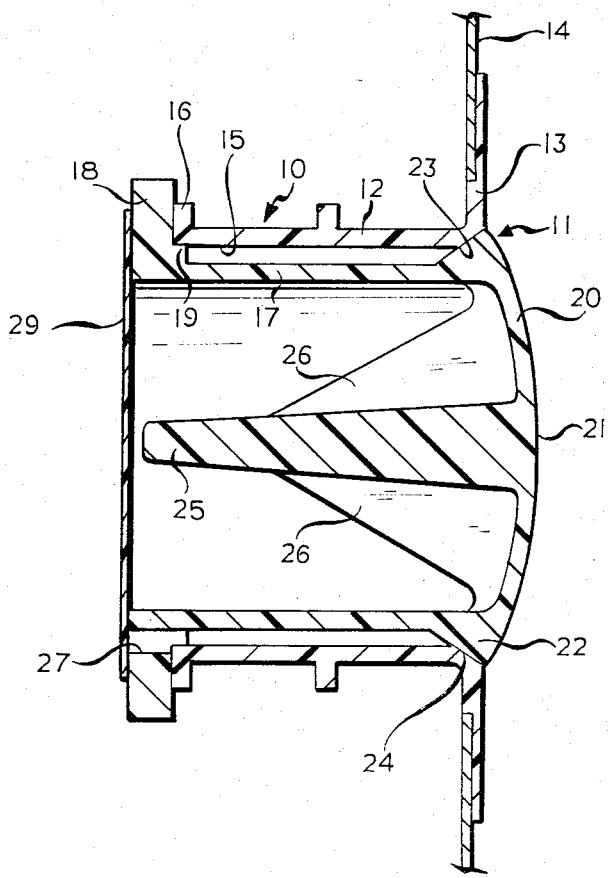
FIG. 1 is a fragmentary sectional view of a dispensing valve embodying the invention.

Referring to FIG. 1, the dispensing closure valve embodying the invention comprises a generally cylindrical stem 10 and a closure 11. The stem is made of thermoplastic material such as low density or high density polyethylene (LDPE or PE) and the closure is made of a stretchable elastomeric material such as methacrylate-butadine-styrene (MBS) and possibly a small amount of polyethylene or from butadie-styrene and ethylene vinyl alcohol (EVA) which will flex in cross section to permit dispensing of the contents as presently described.

The stem 10 includes an annular wall 12 that defines a spout and a radial wall 13 at the inner end that forms a means for attachment to the container such as a bag 14 in a manner well known in the art. The stem 12 defines an integral cylindrical surface 15. The stem includes a radial wall 16 at the outer end.

The closure 11 includes an annular axial wall 17, an outer radial wall 18 engaging the outer wall 16 of the stem and including an annular shoulder 19 for engaging the inner surface of the annular wall of the stem. The closure 11 further includes a transverse wall 20 that is of generally uniform thickness and defines a convex surface 21 facing inwardly. An integral annular bead 22 is provided at the outer surface of the juncture of the annular wall 17 and transverse wall 20 and defines a radially outwardly and axially inwardly inclined sealing surface 23 that engages a complementary sealing surface at the juncture of the annular wall 12 and inner radial let opening 27*a* is provided in the stem 10 rather than the closure 11.

Figure 2:
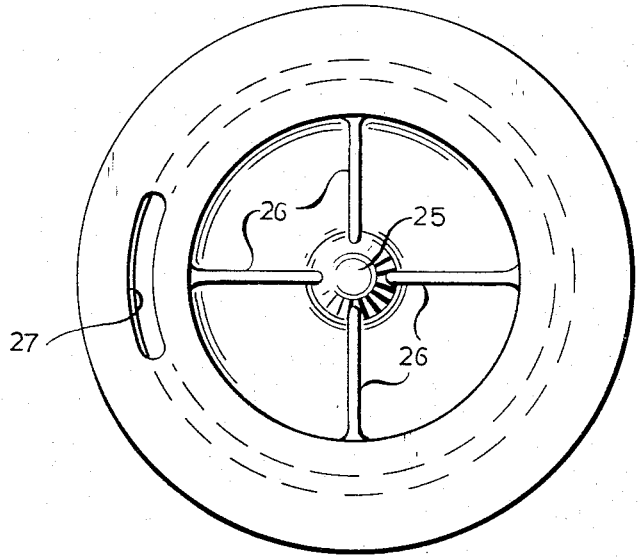
FIG. 2 is a top plan view of the dispensing closure valve, with the cover removed.
Figure 3:
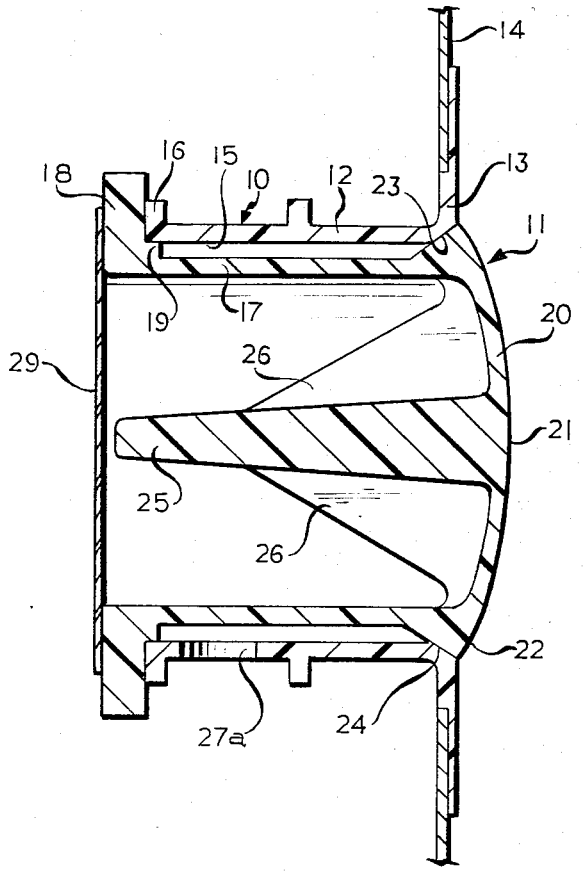
FIG. 3 is a fragmentary sectional view of a modified form of dispensing closure valve.
Figure 4:
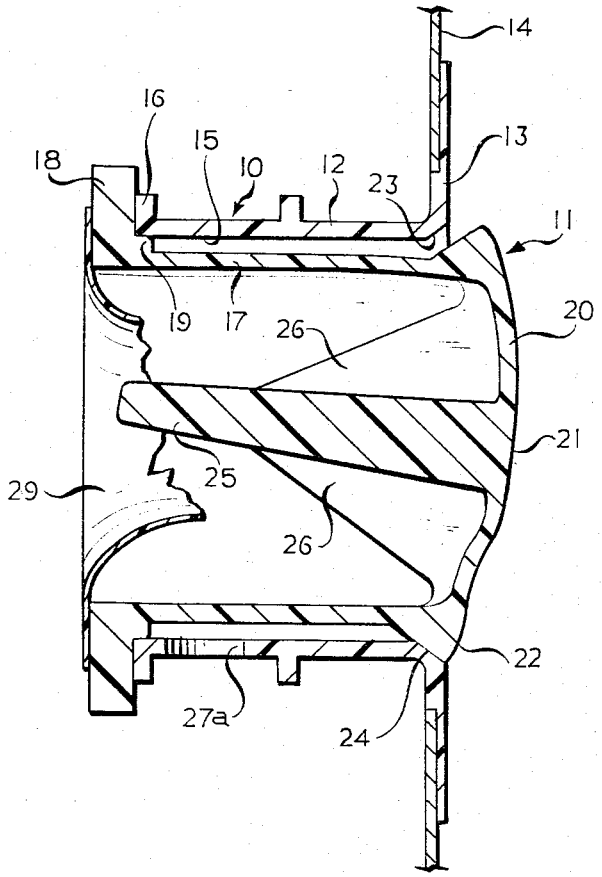
FIG. 4 is a fragmentary sectional valve similar to FIG. 3 showing the dispensing closure valve being actuated for dispensing.

In each form of the invention, a cover 28 of thin frangible material such as paper is attached to the radial wall 18 as by adhesive. In the form shown in FIGS. 1 and 2 the cover 28 also closes the opening 27.

Cover 28 protects the closure and functions as a tampering indicating member. In order to dispense the contents the cover is broken providing access to the actuator 25. Cover 28 is also utilized as a means for carrying opening instructions as well as to protect the opening from accumulation of dirt or other contaminants.

I claim:

1. A dispensing closure valve for a container comprising a stem having a free end and an opposite end for attachment to the container, said stem having an annular wall defining an opening through the stem, and a closure made of plastic material such that it will flex in thin cross section, said closure having an annular axial wall, a radial wall engaging the free end of said stem, and a transverse wall curved and defining a convex surface extending from said annular axial wall and facing inwardly of the container, said closure including a radially outwardly and axially inwardly inclined integral annular sealing surface at the juncture of said axial wall and transverse wall, said stem having a downwardly and outwardly inclined sealing surface engaged by said downwardly and inwardly inclined sealing surface of said closure, and an actuator comprising a tab extending axially from the inner surface of the transverse wall for manipulation of the closure to flex the axial wall and the transverse wall and thereby permit the contents to flow between the wall of the stem and the wall of the closure.

2. The dispensing closure set forth in claim 1 including an outlet opening in said stem.

3. The dispensing closure set forth in claim 1 wherein said sealing surfaces on said stem and closure comprise frustoconical surfaces that are inclined radially outwardly and radially inwardly.

4. The dispensing closure set forth in claim 1 wherein the distance between underside of the radial wall on the closure and the integral annular sealing surface on said closure is less than the distance between the top surface of the radial wall on the stem and the inclined surface of the stem such that the axial wall of the closure is under axial tension.

5. The dispensing closure set forth in claims 1, 2, 3 or 4 including a cover of frangible material bonded to said radial wall of said closure and overlying the entirety of said transverse wall to protect the closure and to function as a tamper indicating member.

6. A dispensing closure valve for a container comprising a stem having a free end and an opposite end for attachment to the container, said stem having an annular wall defining an opening through the stem, and a closure made of plastic material such that it will flex in thin cross section, said closure having an annular axial wall, a radial wall engaging the free end of said stem, and a transverse wall curved and defining a convex surface facing inwardly of the container, said closure including a radially outwardly and axially inwardly inclined integral annular sealing surface at the juncture of said axial wall and transverse wall, said stem having a downwardly and outwardly inclined sealing surface engaged by said downwardly and inwardly inclined sealing surface of said closure, and an actuator comprising a tab extending axially from the inner surface of the transverse wall for manipulation of the closure to flex the axial wall and the transverse wall and thereby permit the contents to flow between the wall of the stem and the wall of the closure, an outlet opening at the radial wall of said closure.

7. A dispensing closure valve for a container comprising a stem having a free end and an opposite end for attachment to the container, said stem having an annular wall defining an opening through the stem, and a closure made of plastic material such that it will flex in thin cross section, said closure having an annular axial wall, a radial wall engaging the free end of said stem, and a transverse wall curved and defining a convex surface facing inwardly of the container, said closure including a radially outwardly and axially inwardly inclined integral annular sealing surface at the juncture of said axial wall and transverse wall, said stem having a downwardly and outwardly inclined sealing surface engaged by said downwardly and inwardly inclined sealing surface of said closure, and an actuator comprising a tab extending axially from the inner surface of the transverse wall and the transverse wall and thereby permit the contents to flow between the wall of the stem and the wall of the closure, an outlet opening at the radial wall of said closure, and a cover of frangible material bonded to said radial wall of said closure and overlying the entirety of said transverse wall to protect the closure and to function as a tamper indicating member.

8. The dispensing closure set forth in any of claims 1, 2, 3, or 4 wherein said annular wall of said stem includes a radial wall at the opposite end, said sealing surface of said stem being at the juncture of said radial wall of said stem and said annular wall of said stem.

* * * * *